US005605565A

United States Patent [19]

Feldstein

[11] Patent Number: 5,605,565

[45] Date of Patent: Feb. 25, 1997

[54] PROCESS FOR ATTAINING METALLIZED ARTICLES

[75] Inventor: Nathan Feldstein, Princeton, N.J.

[73] Assignee: Surface Technology, Inc., Trenton, N.J.

[21] Appl. No.: 465,401

[22] Filed: Jun. 5, 1995

Related U.S. Application Data

[63] Continuation-in-part of Ser. No. 270,622, Jul. 5, 1994, abandoned, which is a continuation-in-part of Ser. No. 824,655, Jan. 23, 1992, abandoned.

[51] Int. Cl.[6] ..... C23C 18/31; C23C 18/00

[52] U.S. Cl. ..... 106/1.22; 106/1.25; 427/437

[58] Field of Search ..... 106/1.22, 1.25; 427/437

[56] References Cited

U.S. PATENT DOCUMENTS

| | | | |
|---|---|---|---|
| 4,547,407 | 10/1985 | Spencer, Jr. | 427/367 |
| 4,716,059 | 12/1987 | Kim | 106/1.22 |
| 4,830,889 | 5/1989 | Henry et al. | 427/438 |
| 4,997,686 | 3/1991 | Feldstein et al. | 427/437 |
| 5,145,517 | 9/1992 | Feldstein et al. | 106/1.27 |

*Primary Examiner*—Helene Klemanski

[57] ABSTRACT

Disclosed herein are processes for the metallizing of an article to provide on the surface thereof a metallic coating free of codeposited particulate matter comprising the contacting of said article with a metallizing composition having dispersed therein finely insoluble particulate matter which are not codeposited within said metallic coating during the plating process. Said process provides an improved surface morphology in comparison to the metallic coating derived from said metallizing composition in the absence of said insoluble particulate matter.

30 Claims, No Drawings

PROCESS FOR ATTAINING METALLIZED ARTICLES

REFERENCE TO PRIOR APPLICATION

This application is a continuation-in-part of application Ser. No. 08/270,622, filed Jul. 5, 1994, now abandoned, which is a continuation-in-part of application Ser. No. 07/824,655, filed Jan. 23, 1992, now abandoned.

SUMMARY OF THE INVENTION

The dispersing of a significant amount of suspended insoluble particles (particulate matter) in a plating bath during plating, without their incorporation into a coating, yielding an improved coating with minimal imperfections as compared to a coating derived from the same plating bath without the presence of such suspended insoluble particles.

DETAILED DESCRIPTION OF THE INVENTION

One of the problems often encountered in electroless plating or electroplating of metals on surfaces is imperfections in the plated coatings. While some imperfections may result due to improper processing parameters or lack of cleanliness of the substrate's surface, quite often imperfections also result from the entrapment of small dust or dirt particles present in the environment and plating bath. Imperfections may also result from gaseous by-products (e.g., hydrogen) generated at the solution-substrate interface during the deposition process. Imperfections often become more pronounced as thicker coatings are deposited.

There is one activity in the plating industry wherein entrapment of particles together with the metal to be plated is highly desirable. This activity is commonly termed "composite plating" wherein particles such as diamond, ceramic, carbides, graphite fluoride, PTFE and others are dispersed in the plating solution and are entrapped and included within the plated coating during the plating process. In such processes, it is required to disperse the material to be codeposited with the metal ions in the plating solution so as to obtain the composite coating.

During the past two decades, attention was focussed on the codeposition of finely divided particulate matter resulting in various commercial processes. Early work, done by Oderkerden (British Patent 1,041,753 and U.S. Pat. No. 3,644,183), relied on the formation of an intermediate layer of a composite nature for the purpose of improving the overall corrosion resistance of a nickel/chromium electrodeposited structure.

Metzger et al (U.S. Pat. No. 3,617,363) extended their efforts in the codeposition of a greater variety of particulate matter, especially within electroless nickel matrices. A great variety of particulate matter was noted by Metzger et al as potentially suitable for composite electroless deposition. These particulate matters are summarized in col. 4, lines 35–53 of Metzger et al.

Christini et al (U.S. Pat. No. Re. 29,285) demonstrated the codeposition of diamond in electroless plating processes, as well as of other particles. Parker (U.S. Pat. Nos. 3,562,000 and 3,723,078) demonstrated the codeposition of various metals (e.g., chromium), along with electroless metal deposition.

Feldstein et al (U.S. Pat. No. 4,997,686 and U.S. Pat. No. 5,145,517) demonstrated the use of additives and combinations thereof to improve the performance of composite electroless plating.

Kim et al (U.S. Pat. No. 4,716,059) and Henry et al (U.S. Pat. No. 4,830,889) found improvements for the codeposition of graphite fluoride in electroless plating.

Spencer (U.S. Pat. No. 4,547,407) demonstrated the advantages associated with the combination of two nominal sizes of particulate matter as reflected in the subsequent ease of smoothing of the resulting composite in comparison to the composite having the large particles only.

The state of the art in composite electroless plating is well documented in a recent text "Electroless Plating: Fundamentals and Applications", G.O. Mallory and J.B. Hadju, editors, published by the American Electroplater and Surface Finishers Society, 12644 Research Parkway, Orlando, Fla. 32826, 1990, Chapter 11 (pp. 269–287 incl.) by N. Feldstein.

As noted, much of the above effort was aimed at the successful codeposition of the particulate matter to secure new composites. Moreover, significant effort was also devoted to insure the successful codeposition of lubricating particles such as PTFE and graphite fluoride.

All of the above patents, texts and publications are incorporated herein by reference.

In the past, when a smooth (non-composite) coating of metal(s) or alloy thereof was desired, free of imperfections, it was always believed that any insoluble particulate matter (e.g., dust) must be eliminated from the plating solution, and/or environment, must provide extremely clean substrates, and must insure the removal of gaseous by-products(s) or other by-products from the solution-substrate interface. I have now discovered that improved coatings of the composite-free (without the occlusion of particles) type, which are substantially free from imperfections and improved morphology, can be produced by the deliberate addition of a significant quantity of insoluble particles which are dispersed (suspended) in the plating solution during the plating process. The amount of particles to be dispersed in the plating solution during the plating process depends upon the particle size employed, but must be of such particle size, quantity, and charge so that these particles are not themselves entrapped (co-deposited) within the metal or alloy coating during the plating process. As it will become apparent, the present invention relies upon the presence of the particles at the solution-substrate interface. When no particles are present in the plating bath the present improvement does not play a role. Hence, it is contemplated that the present phenomenon of improved plating performance is initially concentration dependent on particles added. Ultimately the plating improvement becomes independent of the concentration of insoluble particles used. That is, plating improvement will increase with increasing concentrations of added insoluble particles. However, once a certain concentration is reached, it is contemplated that further plating improvements will be nominal or unchanged. The best concentration of particles can be judged for each case upon simple additions and evaluation of the resulting coating. At the same time, the charge on the particle(s) should be of such nature which will have the least probability of codeposition. For instance, PTFE in electroless plating requires a positive charge for effective codeposition. To prevent its codeposition a negative charge will be in order. To charge the particles certain additives should be included ranging from surfactants (cationic, anionic, etc.), to dispersants and others. The charge on the particles can be measured via the Zeta potential as taught in U.S. Pat. No. 4,997,686 which includes other additives or as coined "particulate matter stabilizers." U.S. Pat. No. 4,997,686 is included herein by reference.

The term "dispersant" as used herein refers to an additive which provides and assists in the ability for the insoluble particles to become dispersable within the plating bath (composition). The dispersant tends to modify the charge on the particulate matter, probably by some electrostatic interaction and the alteration of the double layer. In general, the dispersant will cause a significant shift in the Zeta potential of the particulate matter when dispersed in water. Dispersant materials may be selected from the classes of surfactants, dispersants of various charges, and emulsifying agents.

When referring to the shift in Zeta potential for the insoluble particles, it is noted that such measurements are relative to the addition of the dispersant and its absence. All measurements are made in water only and thus the only variable is the addition of the dispersant. The measurement of the Zeta potential is a simple procedure but which requires a special apparatus.

Useful particles are generally in the size range of 0.05 to 100.0 microns, and they can be either of a lubricating nature or wear-resistant type, though the lubricating type may be preferred. It should be recognized that the selected particles must be inert and must not react chemically with the plating bath. Moreover, in the case of lubricating particles (e.g., PTFE; FEP; graphite-fluoride; boron nitride; graphite; molydisulfide; talc; mica; $WS_2$; AgS; $WSe_2$; $NbSe_2$; $MoSe_2$; $MoTe_2$; $CaF_2$; FeS; and others), generally certain preferred conditions are noted.

Whenever the lubricating particles are 1-micron in size and less, their charge should be negative. The charging of the particle can be executed in accordance to the teaching of U.S. Pat. No. 4,997,686. However, for particles greater than 1-micron in size this negative charge is optional.

It is contemplated that for lubricating particles which are 1-micron and less, that their charge, i.e., net Zeta potential, should be negatively charged in accordance to the teaching of U.S. Pat. No. 4,997,686. Moreover, though optional, particles greater than 1-micron may also be negatively charged.

It is hypothesized that these insoluble particles which are dispersed in the plating solution act in several ways including as a shield against the precipitation of co-deposition of dust or dirt particles or insoluble hydrolysis products which may be present in the plating bath, and at the same time assist in the removal of gaseous by-product generated during plating by the constant bombardment against the surface while still permitting the basic ionic reaction(s) and/or electrochemical reaction(s) to take place at the metallic interface being plated.

It is also believed that it is preferable to use particles which have a negative surface charge (Zeta potential), not only to discourage the deposition or codeposition of the particles together with the metal to be plated, but also to attract and tie up any smaller dust or dirt particles on the surface of the part to be plated by means of electrostatic attraction. It should be understood, however, that the invention as described herein should not be limited by the aforementioned hypothesis.

The term "surface morphology" as used herein is intended to encompass the various aspects of the coating which include any of the following properties: level of pits, surface roughness, general uniformity of the coating, density, porosity and combinations thereof.

It should also be noted that the results achieved by the addition of a significant quantity of particles to the plating solution is highly unexpected, and is generally contrary to the teachings of the prior art of plating, especially in conventional electroless plating where removal of particles by filtration is generally encouraged for a good practices.

The present invention is also unique for variety of reasons including, but not limited to:

1. While the presence of the insoluble suspended particles assists in securing improved deposits, they also act as a "catalyst" in the sense that they are not consumed in the course of the plating process. By contrast, levelling agents and brighteners are exotic compounds which are typically consumed during the course of the plating process and also disintegrate and yield miscellaneous by-product(s) and hence add to the cost of manufacturing.

2. The formation of improved coatings eliminates and minimizes additional mechanical surface finishing operations, (e.g., buffing) thereby providing significant cost savings.

There are many coated precision parts which require high quality coatings. One such example is modern data storage discs. These discs are generally manufactured on aluminum substrates and coated with nickel, polished to an ultra smooth surface; thereafter a magnetic layer is deposited.

The following are the key steps prior to the deposition of the magnetic layer in a typical process for the preparation of such discs.

1. Rough finish of aluminum blank
2. Clean after rough finish
3. Final finish aluminum disc
4. Clean finish aluminum disc
5. Aluminum substrate inspection
6. Preplate cleaner and chemical pretreatments
7. Zincating activation
8. Electroless nickel plate
9. Prepolish inspection
10. Polish nickel plated disc
11. Clean polished disc
12. Inspection and shipping Defects in the final polished surface cannot exceed 1–2 millionths of an inch. Typically, the nickel plating currently executed yields a plating thickness of 450 micro-inch at a rate of approximately 5 micro-inch per minute with a phosphorous content of approximately 11% and higher. The latter is required to insure and retain the non-magnetic properties of the nickel coating. It should be recognized that with increasing needs for higher information density, greater perfection of such discs is required. In fact, the plating of such discs is generally carried out under clean-room conditions with the filtration of the bath to remove any insoluble particles in the plating bath. Consequently, the present invention is aimed at the manufacture of such discs, and it applies to many other uses as well.

The following are examples of the novel process and some plating baths used in such processes for the electroless plating or electroplating of smooth, imperfection-free, metals on a substrate. While the examples are given solely in terms of electroless plating, it will be understood by those skilled in the art that similar improvement would be obtained employing electroplating baths as well, which, however, may require a suitably designed plating cell (tank) to maintain the dispersed particles in the same cathodic compartment. In the latter case (electroplating) the added particles should be dispersed with a charge of a type and a magnitude adequate to prevent their codeposition onto the cathode during the plating cycle and preferably separated from the anode by suitable membranes or porous ceramic separators.

The following examples illustrate the novel concept of the present invention. It should be recognized that the invention is not limited to the exclusive teaching of these examples. The invention should be taken as a whole as taught by applicant, since a variety of plating baths, including plating of metals other than nickel, and a variety of insoluble particulate matters, can be selected, leading to many combinations.

EXAMPLE 1

A commercial electroless nickel plating bath sold under the name "ADDPLATE 120", a product of Surface Technology, Inc., Trenton, N.J., was used. PTFE powder was used as insoluble particulate matter with primary particles of approximately 0.2 to 0.3 micron in size. To render the PTFE hydrophilic, the powder was treated with a reaction product of stannic ions and sodium chloride in accordance with the teachings of U.S. Pat. Nos. 3,667,527 and 3,982,054, as well as UK Patent 1,348,793. After treating the PTFE powder with the tin composition the excess tin was rinsed with DI water yielding PTFE powder which was hydrophilic in its wetting properties. The treated powder was then readily dispersed within the aqueous electroless plating bath with the help of mechanical agitation. Approximately 3 g/l of the PTFE powder was added and dispersed within the electroless plating bath and processed under the conditions normally recommended by the manufacturer. A control coupon was placed in the ADDPLATE 120 bath without the added PTFE powder and a second coupon of the same type was placed in a similar bath incorporating the PTFE powder.

After 1 hour of plating time the plating rates (as noted by the weight gain) were identical, within experimental error, for the two coupons. Thus, the presence of the finely divided dispersed PTFE powder apparently did not inhibit the plating reactions taking place at the interface.

However, a significant improvement was observed in the appearance of the second (test) coupon in comparison to the control. The test coupon coating appeared to be shinier with less noted graininess of the background substrate, whereas the control coupon was dull (in comparison to the test coupon) with noted graininess of the substrate.

It was also recognized that, due to the nature of the PTFE and its normally highly hydrophobic properties, the powder tends to coagulate and float with time. Consequently, it is anticipated that the coagulated product should be removed, and freshly treated hydrophilic PTFE should be added for continuous commercial operation.

EXAMPLE 2

A dispersion was prepared comprised of 1 gram of dispersing agent (the composition used was a sodium salt of condensed naphthalene sulfonic acid manufactured by Rohm & Haas Company and sold under the name of Tamol), and 12 grams of HCP (boron nitride) having a mesh size −325 (product of Union Carbide) and 88 grams of water. The mean particle size of this product is about 7 to 10 microns. Forty (40) ml of this dispersion was added to 500 ml of an ADDPLATE 120 commercial electroless nickel plating bath. Standard size steel coupons were cleaned, dried, and weighed. The plating bath was then run for two (2) hours at 87° C. A control ADDPLATE plating bath without the particulate matter additive was run in the same manner to establish a baseline for comparison of the results.

The control coupon (size 2"×¾") had a weight gain of 0.431 grams per coupon, whereas the same plating bath with the addition of 40 ml of the above boron nitride dispersion resulted in a weight gain of 0.422 grams per coupon.

It appears that the weight gains for the two plating baths (with or without the dispersion) are essentially identical and within experimental error.

Microscopic examination of the test coupon revealed a surface finish free of pits (free of defects). In comparison, defects and pits could be observed on the control coupon.

A cross sectional cut was made. No boron nitride particulate matter was found within the test coupon coating at 1,000 magnification.

This example further supports the concept of the present invention, whereby the presence of insoluble particulate matter in the plating bath during deposition appears to provide a manner by which improved plated parts can be obtained even though they are not occluded within the coating. The appearance of the test coating is a dull finish.

In addition to the above, the measured surface roughness for the coating was examined. It was found that the test coupon of the present invention had a superior microlevelling effect in comparison to the control coupon.

As noted above, there appears to be a microlevelling effect with respect to the surface roughness of the resulting coating of this invention. While I do not wish to be bound by theory, it is believed that the insoluble particles dispersed are adsorbed onto the high points (sites) of the surface blocking the ionic reactions leading to the metallic deposition at such sites, however, permitting the ionic reaction to proceed within the low-points (valleys) of the surface, hence leading to this levelling effect.

EXAMPLE 3

The experiment as set forth in Example 2 was repeated, except that only 0.4 grams of Tamol was added to the ADDPLATE 120 bath without any boron nitride particles. It was noted that the deposit from this bath was essentially identical to the control, and the plating rate remained the same. Thus, the improvement of Example 2 is solely attributed to the presence of boron nitride even though it was not incorporated into the deposit.

EXAMPLE 4

Similar to Example 2, a dispersion consisting of 88 grams of water, 1 gram of Tamol, and 12 grams of Accufluor (Allied Signal's fluorinated carbon $CF_x$-grade) was prepared.

Subsequent to the preparation of the dispersion, 50 ml of the Accufluor dispersion was added to 500 ml of an electroless plating bath (ADDPLATE 120) and plating was conducted.

The test coupon (with added dispersion) resulted in a better quality of coating as compared to the control coupon. No change in plating rate was detected. A cross section of the test coupon revealed the absence of any particles within the deposited metal. The appearance of the test coupon was a dull finish.

This example further illustrates the innovation of this invention.

From the results of Examples 1, 2, and 3 it is recognized that, if desired, by the mechanical removal of the particles from the plating bath, a reversal in the type of coating obtained can be achieved from a single plating bath.

EXAMPLE 5

Three hull cell panels were plated and designated "A", "B", and "C". The plating bath used provides a nickel-phosphorous alloy with a low phosphorous content and a hardness of about 670 $KHN_{50}$ as plated.

Panel "A" was plated in the plating composition alone for a period of 2½ hours and the resulting coating was evaluated in terms of weight gain (W=4.099 gr) and hardness of 650 $KHN_{50}$ for the coating.

Panel "B" was plated under the same conditions as above, but with the presence of Tamol at a concentration of 0.9 gr/l. Tamol was used alone since it is cointroduced along with particles in Panel "C". The weight gain was within experimental error to panel "A".

Panel "C" was plated in the solution produced by using the solution of panel "B" combined with boron nitride (HCP) particles at a concentration of 22 gr/l to yield bath "C". The weight gain was 4.487 gr for the same cycle in above.

All platings were done under the same conditions and durations.

At the conclusion of the plating of the above three panels the hardness of panels "A" and "C" were substantially the same, i.e., 650 to 670 $KHN_{50}$. At the same time, a cross-section of panel "C" indicated no co-deposition of any particulate matter. Furthermore, it was noted that pitting and some streaking took place with panels "A" and "B", yet little or no pitting was observed with panel "C". The thickness for the above panels are above 1 mil. In general, it is very difficult to deposit such coatings greater than 1-mil in thickness and avoid the formation of pits.

EXAMPLE 6

In this example by separation, the smaller particles within the HCV powder were removed by a settling approach. HCV is a boron-nitride powder manufactured by Union Carbide. Specifically, after suspending the particles in water and allowing the heavy particles to settle and the smaller particles to remain floating, separation occurred. The portion containing the large particles was used. Relative results showed a shinier surface when compared to the control. It is believed that some very small particles could be entrapped within the coating on a very limited basis. Hence, it is generally preferred to omit very small particles, or in the alternative, negatively charge the particles via added dispersant(s) to minimize any tendency of codeposition. It is thus recommended, for particles having a broad range in particle size, that separation and removal of the small particles take place prior to the implementation of the current invention.

Further, particle sizes for the dispersed particles typically range from 0.05 to 100.0 microns and should be present in concentrations generally in excess of a fraction of 1 gram/liter. Typically, concentrations are greater than 0.2 g/l. Where particle sizes are small, the concentration (g/l) can be lowered since it is not the weight concentration but rather volume concentration of the particles that probably plays the major role at the solution-substrate interface. It should be understood that the invention is not limited to any specific particle, particle size, and/or concentration of particles being dispersed.

To assist in the dispersion or charging of the insoluble particles, additives such as dispersant(s) may be added, and/or mechanical agitation, and/or gas agitation may be applied within the plating bath (especially during the plating cycle).

It is also noted that this invention does not rule out the codeposition of certain particles, e.g., silicon carbide, in the presence of the current invention. Hence, in the plating bath there will be at least two particles: one which is codeposited, and one which is does not codeposit.

I have also recognized that, due to the great variety of plating compositions for either electroless plating or electrolytic plating, a dispersion suitable for a specific composition may be limited in its effectiveness in a different composition. This limitation is anticipated due to the varied type(s) and concentrations(s) of electrolytes (see above test: "Electroless Plating Fundamentals and Applications").

Electroless and electroplating processes and plating baths are well known in the art and need not be specifically set forth herein. Examples of electroplating baths and processes can be found in the text "Electroplating Engineering Handbook", A. K. Graham, 3rd edition, Van Nostrand Reinhold Company, Publisher. This text is included herein by reference.

What is claimed is:

1. A process of metallizing a body to provide on the surface thereof a codeposit-free metal coating comprising contacting the surface of said body with a metallizing bath having dispersed therein finely divided insoluble particles which are not codeposited with said metal coating, said metal coating having a surface morphology better than the morphology of a surface of a metal coating produced by said metallizing bath devoid of said insoluble particles.

2. The process according to claim 1 wherein said body is a memory member.

3. A plating bath for depositing on the surface of a body a codeposit-free metal coating, said bath comprising a solution of metal ions to be plated, and finely divided insoluble particles which are not codeposited with said metal ions dispersed within said solution, said insoluble particles being of a lubricating nature having a negative Zeta potential.

4. A plating bath for depositing on the surface of a body a codeposited free metal coating said bath comprising a solution of metal ions to be plated and finely divided insoluble particulate matter which are not codeposited along with said metal ions, wherein, said particles are dispersed within said solution and further wherein said insoluble particles selected from the group consisting of PTFE, FEP, boron nitride, graphite, $MoS_2$, TaLc, Mica, $WS_2$, AgS, $WSe_2$, $NbSe_2$, $MoSe_2$, $MoTe_2$, $CaF_2$, FeS, and mixtures thereof.

5. The plating bath according to claim 4, wherein said insoluble particles have a negative zeta potential when measuring said potential in water alone in the presence of a dispersant.

6. An electrolytic plating bath for depositing on the surface of a body a codeposited free metal coating said bath comprising auxiliary electrodes a solution of metal ions to be plated and finely divided insoluble particulate matter which are not codeposited along with said metal ions, wherein said particles are dispersed within said solution and further wherein said insoluble particles selected from the group consisting of PTFE, FEP, boron nitride, graphite, MoS2, Talc, WS2, graphite fluoride, AgS, SWe2, NbSe2, MoSe2, MoTe2, CaF2, FeS, and mixtures thereof.

7. The plating bath according to claim 4, wherein said metal is deposited by electroless (chemical) method deposition.

8. The plating bath according to claim 4, wherein said insoluble particles are selected in quantity dependent upon the particle size and charge to eliminate their codeposition within said metal coating.

9. The plating bath according to claim 4, wherein said bath further comprises a dispersant.

10. The plating bath according to claim 4, further comprising a secondary insoluble particles which are codeposited during the deposition of said metal ions.

11. A process of metallizing a body to provide on the surface thereof a smooth metal coating comprising contacting the surface of said body with a metallizing bath having dispersed therein a quantity, particle size and charge that the insoluble particles are not co-deposited with the metal and metallizing said body so as to produce a metal coating thereon.

12. The process recited in claim 11 wherein said metallizing bath is a nickel electroless metallizing bath.

13. The process recited in claim 11 wherein said metallizing bath is an electroplating bath.

14. The process recited in claim 11 wherein the body to be metallized has a metal surface and functions as a cathode in the metallization process, said process further including the step of applying a voltage across an anode and a cathode, both placed in the metallizing bath.

15. The process according to claim 11 wherein the metal coating is smoother in comparison to the resulting smoothness for coating resulting from a metallized bath without the presence of the insoluble particles.

16. The process of metallizing the surface of a body with an improved surface finish metal coating, said process comprising providing a plating bath for metallizing said body with a metal coating, dispersing in said plating bath finely divided insoluble particles, selecting said particles having a nature, size and quantity whereby said particles are not co-deposited with said metal coating, and contacting the surface of said body with said plating bath to produce a metal coating thereon substantially free of said particles, wherein said metal coating has an improved surface finish in comparison to the surface finish of a metal coating produced in said plating bath devoid of said insoluble particles.

17. A process of metallizing the surface of a body with an improved metallic coating, said process comprising;

1. Selecting finely divided particulate matter having a nature, size and quantity so that the particles are not co-deposited within said metallic coating and dispersing said particulate matter within an electroless plating composition, and
2. Contacting said body with said electroless plating composition along with said particulate matter to deposit said metallic coating devoid of said particulate matter resulting in an improved metallic coating in comparison to a coating derived from the same electroless plating composition devoid of said particulate matter.

18. An improved process for metallizing the surface of a body, said process comprising contacting said body with a plating composition with finely divided insoluble particulate matter dispersed therein to provide a metallic coating substantially free of any codeposited particulate matter and having improved surface properties for said coating in comparison to the coating resulting from said process without said particulate matter dispersed within said plating composition and further said particulate matter is a lubricant.

19. The process according to claim 18 wherein said lubricant is having a negative zeta potential charge.

20. The process according to claim 14 wherein said insoluble particles are 1-micron and less in size and further having a negative zeta potential.

21. An electrolytic plating bath for depositing on a substrate a codeposit-free metal coating, said bath comprising auxiliary electrodes, a solution of metal ions to be plated, and finely divided insoluble particles dispersed within said solution, said insoluble particles are not codeposited with said metal ions.

22. A process of metallizing a substrate with an improved metallic coating, said process comprising;

1. Selecting finely divided insoluble particulate matter having a nature, size, charge and quantity so that said particulate matter are not co-deposited within said metallic coating and dispersing said particulate matter within an electrolytic plating composition, and
2. Contacting said substrate with said electrolytic plating composition along with said particulate matter to deposit said metallic coating devoid of said particulate matter resulting in an improved metallic coating in comparison to said metallic coating derived from said electrolytic plating composition devoid of said particulate matter.

23. The process according to claim 17 wherein said electroless plating composition is a low phosphorous bath.

24. The plating bath according to claim 6 further comprising a dispersant.

25. The plating bath according to claim 24 wherein said dispersant in combination with said particulate matter in water alone yield a negative Zeta potential.

26. The process according to claim 11 wherein said charge is a negative Zeta potential when measuring said insoluble particles in combination with an added dispersant in water alone.

27. The process according to claim 16 wherein said plating bath further comprises a dispersant.

28. The process according to claim 17 wherein said electroless plating composition further comprises a dispersant.

29. The process according to claim 20 wherein said plating composition further comprises a dispersant.

30. The plating bath according to claim 23 wherein said bath further comprises a dispersant.

* * * * *